United States Patent [19]

Gorlitz et al.

[11] Patent Number: 4,469,230

[45] Date of Patent: Sep. 4, 1984

[54] SORTING CYLINDER FOR SEEDS AND OTHER GRAINS

[75] Inventors: Frank O. Gorlitz, Braunschweig, Fed. Rep. of Germany; Werner Hohener, Oberuzwil, Switzerland

[73] Assignee: Gebrueder Buehler AG, Uzwil, Switzerland

[21] Appl. No.: 320,952

[22] PCT Filed: Mar. 20, 1981

[86] PCT No.: PCT/EP81/00023

§ 371 Date: Nov. 6, 1981

§ 102(e) Date: Nov. 6, 1981

[87] PCT Pub. No.: WO81/02695

PCT Pub. Date: Oct. 1, 1981

[30] Foreign Application Priority Data

Mar. 22, 1980 [DE] Fed. Rep. of Germany ..... 3011173

[51] Int. Cl.[3] ..... B07C 5/36; B07B 1/22

[52] U.S. Cl. ..... 209/683; 209/369; 209/370; 209/390

[58] Field of Search ..... 209/683, 686, 687, 288, 209/296, 370, 372, 664, 369, 385, 389, 390

[56] References Cited

U.S. PATENT DOCUMENTS

| | | | |
|---|---|---|---|
| 453,185 | 6/1891 | Gschwender | 209/683 X |
| 487,009 | 11/1892 | Abbott | 209/372 |
| 904,282 | 11/1908 | Schnitzler | 209/370 |
| 1,030,552 | 6/1912 | Watson | 209/683 |
| 1,070,092 | 8/1913 | Wright | 209/683 X |
| 1,822,921 | 9/1931 | Cooper | 209/683 X |
| 2,018,157 | 10/1935 | Urschel | 209/683 X |
| 2,135,099 | 11/1938 | Brye | 209/687 |
| 2,245,650 | 6/1941 | Christopherson | 209/390 X |
| 2,687,212 | 8/1954 | Kerr et al. | 209/664 X |
| 3,709,329 | 1/1973 | Mlodzinski | 209/683 X |
| 3,750,884 | 8/1973 | Satake | 209/683 X |

FOREIGN PATENT DOCUMENTS 283358 4/1915 Fed. Rep. of Germany .

*Primary Examiner*—Robert B. Reeves
*Assistant Examiner*—Edward M. Wacyra
*Attorney, Agent, or Firm*—Oblon, Fisher, Spivak, McClelland & Maier

[57] ABSTRACT

A sorting cylinder for seeds and other grains with a horizontal, driven calibrating cylinder (11) resting on rolls (22, 23, 24, 25) and with a stationary machine casing (1) surrounding the calibrating cylinder (11) which has an inlet (4) for the material to be sorted and a mechanism (5, 6, 7) to lead off the fractions as well as a detachable longitudinal side wall (41, 42). In order to simplify storage and to facilitate the exchangeability also for untrained operating personnel, the calibrating cylinder (11) freely rests on four supporting rolls (22, 23, 24, 25) and at least one of the four supporting rolls (24; 25) is designed as a driving wheel (25). The calibrating cylinder (11) can be freely lifted off towards the top or can be mounted and dismounted through a longitudinal side (41, 42) of the machine casing (1).

11 Claims, 10 Drawing Figures

SORTING CYLINDER FOR SEEDS AND OTHER GRAINS

TECHNICAL FIELD

The invention refers to a sorting cylinder for seeds and other grains with a horizontal, driven calibrating cylinder resting on rolls as well as a stationay machine casing surrounding the calibrating cylinder which has an inlet for the material to be sorted and means to lead off the fractions as well as at least one detachable longitudinal side wall.

BASIC STATE OF THE ART

Such sorting cylinders to which the invention refers are used for the exact separation by size of mixed grains. In case of seeds, for example, Indian corn grains, the grains must be sorted within a very narrow range of sizes. On the other hand, the size of the seeds is a quality criterion and, on the other hand, each individual grain must be separated from the entire amount of grain for the sowing machine by means of corresponding allotment systems and must be individually sown by the machine. The more uniform the outside dimensions of the grains are, the more trouble-free the sowing will take place. However, a comparatively exact classification by size is also known in connection with other seeds, such as, for example, wheat, rye, rice, soybeans, grass seed, etc. Furthermore, size is, for example, also a quality criterion in case of coffee beans. A typical characteristic of such sorting cylinders lies in the exchangeability of the operating or calibrating cylinder, respectively. Depending on the special requirements of a company which, for example, produces or supplies such types of seeds, it can be necessary to use quite different calibrating cylinders. Thus, it happens quite often that the sorting cylinder (which is the actual heart of the entire seed producing system) must be exchanged on a daily basis.

The classic round screens are not suitable for an exchange of the screen drum or the calibrating cylinder, respectively, by the customer and, therefore, cannot be used for this type of specific calibration of the grains (such as, for example, with the production of seed).

It is known from cereal cleaning machines or screening machines, respectively, to have cylinders supported by rolls and to drive them whereby, however, a free exchangeability of the cylinders is not given. In order to cleam or keep free the holes, it is customary in the case of screening machines as well as sorting cylinders to provide cleaning devices (such as, for example, cylindrical brushes or beater shafts) which are arranged axis-parallel to the screening drum and whose bristles or beaters, respectively, act on the screening drum jacket and loosen grains stuck in its screen holes and make them fall down. In this instance, the brush or beater shaft, respectively, is driven either by its own motor or through a separate power transmission through the driving motor of the screening drum; however, often the brushes are only rotated through the friction between their bristles and the screening drum to be cleaned. The given special fastening as well as the drive of the cleaning device represent often a main obstacle for a simple dismounting or remounting of the screening drum. This indicates often also whether a corresponding drum screen is suitable for use as a sorting screen or not. A cumbersome mounting and dismounting of the cleaning device destroys again the advantage of a simple mounting of the screening cylinder. The majority of screening machines do not provide door-like lateral walls.

With a normal screening process, another activity is, as a rule, carried out, i.e. a quantity concentration as in the case of a sand screen or when shifting out foreign matter (dirt, etc.) from cereal. On the other hand, a precise separation of the goods to be sorted into the desired classes by size is expected or sorting cylinders, similar, for example, to the classifying of the balls for ball bearings. It is, furthermore, expected of a sorting cylinder that, with each change in product, it is free from grains of the preceding product or that it can at least be easily made free from them.

In the case of a known sorting cylinder, the shaft stubs, supporting the cylinder with its rotary motion and driving it, are laterally pulled out for the purpose of a fast exchange of the cylinder so that the cylinder itself can be mounted and dismounted through a detachable lateral wall of the casing. Depending on the condition of the respective element (question of corrosion, correct location of the key within reach, etc.), the exchange of a cylinder can be effected within a few minutes but it may also take up to half an hour or a full hour. The exchange of the cylinder within five minutes is, for example, only possible if the machine is new or very well maintained In the case of other known sorting cylinders, the time required for an exchange of the calibrating cylinder is between one half hour and two hours which, normally, also necessitates stopping the entire system for the corresponding period of time.

The main difficulty lies mostly in the fact that, first of all, a cleaning device must be dismounted and chain or belt drives or transmissions must be loosened which requires well trained personnel at least for the remounting. In contrast to, for example, cement drums or garbage drums, the screening drums or calibrating drums, respectively, with which the invention is concerned are of a light construction and, therefore, they are easy to handle and can be lifted by a single operating person for mounting purposes and they shall also be easily dismountable by hand. Such drums are generally operated in a speed range between 40 and 80 r.p.m. and have mostly cylinder lengths between 1 m and 2 m and cylinder diameters between 200 mm and 400 mm.

DISCLOSURE OF THE INVENTION

Proceeding from the shown state of the art, the invention is based on the task of developing a simply structured sorting cylinder which can be particularly easily mounted in the machine casing and dismounted from it without loss of time and the use of tools even by untrained personnel so that particularly little time and low costs are required for the mounting and dismounting and an especially economical storage of the different basic elements is possible.

According to the invention, this is achieved with a sorting cylinder of the kind mentioned in the introduction in that the calibrating cylinder is freely placed on four supporting rolls, at least one of the four supporting rolls is designed as a driving wheel and the calibrating cylinder can be freely lifted off in an upward movement or can be mounted or dismounted through a longitudinal side of the machine casing.

The experts were greatly surprised that the sorting cylinder according to the invention gave best results already during the first test runs. It was demonstrated that not only an especially simple and quick mounting and dismounting is possible even by untrained personnel but that additionally an absolutely reliable operational security of the entire unit is given with a surprisingly simple construction. It also turned out that the light calibrating cylinder never jumped off the supporting rolls.

A particularly favorable design of the sorting cylinder according to the invention is obtained in that two supporting rolls each are arranged on both end sides of the calibrating cylinder whereby one supporting roll has lateral guide surfaces on the driving side. A strikingly simple additional design of the invention is obtained in that the calibrating cylinder has a driving ring provided with a keyway on its end on the driving side which is engaged with a driving wheel, designed with a corresponding key profile, through friction. In this way, the calibrating cylinder can be inserted without difficulty on the non-driven end side, can be placed on the two supporting rolls and then on the driving roll or the supporting roll, respectively, on the other side. An additional fastening of driving means is eliminated as well as the tightening of screws, belts or chains. After having been inserted and placed on the rolls, the calibrating cylinder is already completely mounted; it is placed directly on its support. It is driven when the motor is cut in and is particularly well held in place against longitudinal movements by means of the key surfaces.

A particularly advantageous design of the calibrating cylinder according to the invention consists also of the fact that the driving ring has laterally a circular-cylindrical running surface and the second support roll arranged on the driving side has also a circular-cylindrical support surface whereby the running surface rests on the support roll. Preferably, the calibrating cylinder is additionally provided with a barrel ring on its end opposite to the drive in the area of the inlet which rests on two corresponding circular-cylindrical support surfaces of the supporting roll. Furthermore, particularly quiet running of the calibrating cylinder is possible when the driving wheel is rigidly connected with an additional supporting roll on the opposite end side of the calibrating cylinder with a continuous drive shaft: in this way, drive of the calibrating cylinder is achieved on its two end sides which protects the screening drum particularly well. It is, moreover, very expedient when the inlet projects into the calibrating cylinder and the calibrating cylinder ends in front of the corresponding end wall of the machine casing by a somewhat greater distance than the projecting depth of the inlet into the calibrating cylinder for the purpose of a simple mounting and dismounting. The suporting rolls designed as driving wheels are preferably made of rubber and the driving ring on the calibrating cylinder of a wear-resistant synthetic material.

An additional advantageous design of the invention lies in the fact that the calibrating cylinder as well as a cleaning device have the driving ring as a joint driving element and the cleaning device has a transmission wheel provided with a corresponding key profile. In this manner, not only a direct drive of the cleaning device is obtained but additionally the possibility of also simply lifting the cleaning device out of the device in the same manner as the calibrating cylinder or of inserting it into the device so that both procedures can indeed be effected each with a single manual movement. Both mentioned parts can be driven and guided by a resting point and a higher or lower driving power is transmitted to them depending on their weight. The wedge shape is ideal for the drive in this instance, particularly with the described design.

The wedge-shaped engagement and the wedge-shaped support at the mentioned point result additionally in advantages for the entire machine which had not been expected: the calibrating cylinder is actually manufactured with very great precision as to the free passages through the openings of the screening drum. An accuracy of $\pm 0.1$ mm is required in the manufacture of the screening openings. The rotating movement of the drum, on the other hand, does not require a special precision in the manufacture. The joint driving of the calibrating cylinder and the cleaning device by the very same driving ring entails the additional advantage that the distance between cleaning device and jacket surface of the screening drum is always constant which applies partially even to minimum movements (such as vibrations, non-circularity, etc.) of the screening drum. This, in turn, results in a gentle cleaning of the screening drum jacket or of the corresponding precision lattice work.

The cleaning device can be advantageously designed as a rotating brush or also as a beater system. Preferably, the transmission wheel of the cleaning device rests on it secured against rotation and the cleaning device itself is guided in a movable manner relative to the calibrating cylinder by means of guiding means fastened to the machine casing. This leads to the fact that, without any difficulties, a brush or a beater system, as required, can be easily inserted as a cleaning device. It is also advantageous when the cleaning device can be moved essentially in a radial direction to the calibrating cylinder in the guiding means whereby the direction of the movement is vertical or slightly inclined to the vertical.

Furthermore, the driving wheel of the cleaning device working together with the driving ring is preferably provided with a corresponding wedge profile; owing to resting on both sides, the driving wheel is only pushed in a friction-locked manner against the driving ring with half the weight of the cleaning device. However, in special cases, a suitable pressure spring which can easily be cut in or cut out can be additionally provided in order to increase the joining power (and thus the friction power). The cleaning device is provided with sliding means on both end sides which can be inserted into the guiding means and are preferably designed as ball or roller bearings.

Another advantageous design of the invention consists of the fact that the calibrating cylinder has a driving ring, a running ring and a paddle shaft whereby the screening drum, the running ring, the driving ring as well as the paddle shaft are designed as a unit which can be fitted together. Preferably, the sorting cylinder is designed in this instance as a module whereby a number of different calibrating cylinders or a number of differently punched screening drums form the variable basic elements. In this manner, it is possible to keep ready for operation a number of different but completely assembled or pre-mounted calibrating cylinders; however, also a corresponding number of different screening drums can be kept ready without mounting or dismounting as basic elements.

Another advantageous design of the invention consists of the fact that the sorting cylinder is designed as a module whereby the cleaning device of this unit can be optionally equipped with a direct drive or with a drive through the calibrating cylinder in such a way that either a rotating brush or a rotating beater system can be used.

Also, several sorting cylinders can be arranged on top of each other. By using a different number of inlets and outlets, even the lost periods for mounting and dismounting—for which indeed only about two or three minutes are required in connection with the solution according to the invention—can be eliminated. Such a system can be automatically controlled in a simple manner by means of corresponding gate valves and control means so that, for example, the calibrating cylinder must only actually be exchanged for special products.

BRIEF DESCRIPTION OF THE DRAWINGS

The invention is still further explained below with the help of the drawing on the basis of the principle and in the way of examples. There are shown.

BEST MODE FOR CARRYING OUT THE INVENTION

Figure 1:
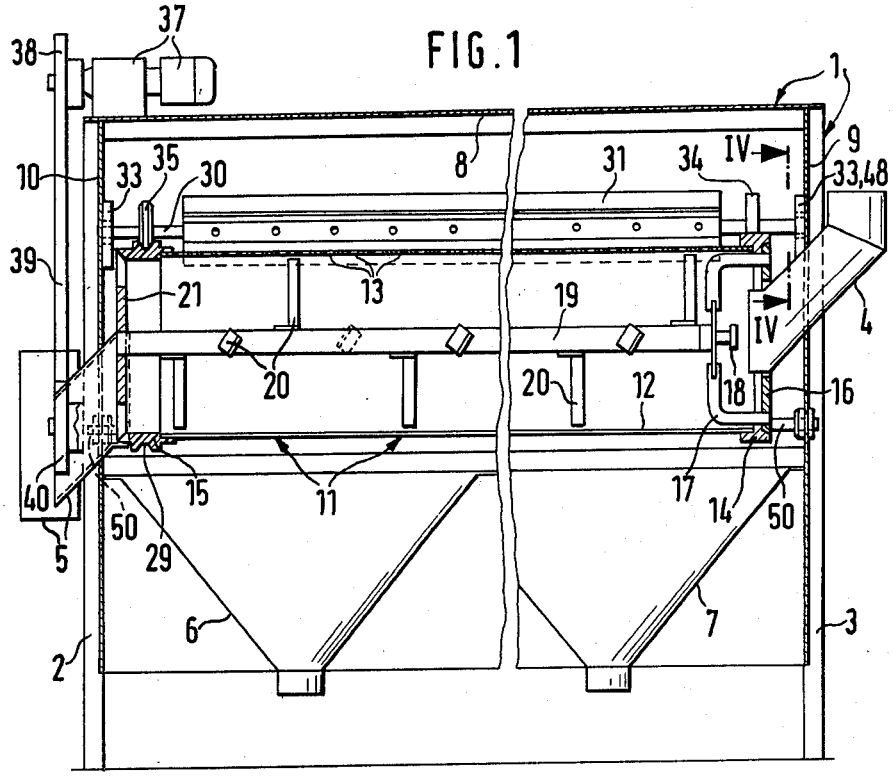
FIG. 1 a partial longitudinal cross-sectional view through a sorting cylinder according to the invention in a simplified representation.
Figure 2:
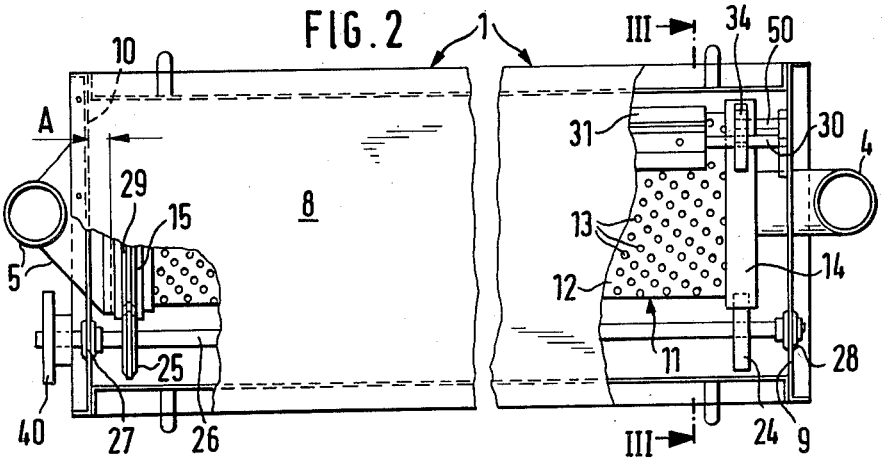
FIG. 2 a partial top view of the sorting cylinder according to FIG. 1 with the machine casing ends shown broken down.

The sorting cylinder consists essentially of four components, i.e.: the machine casing, the calibrating cylinder, the cleaning device as well as the drive.

The machine casing 1 which is closed all around rests on the floor with the help of its two supports 2 and 3 and has an inlet 4 at one front side and an outlet 5 on the other front side for the screening transitions as well as two outlet funnels 6 and 7 on its lower side for the screening passages. The ceiling 8 of the machine casing 1 is screwed on and the two longitudinal side walls 41 and 42 are fastened in a detachable manner as doors by means of a snap closure 49 in order to be able to easily mount, dismount and monitor the calibrating cylinder 11 and, if necessary, the cleaning device 45. The inlet 4 is rigidly connected to the front wall 9 of the machine casing 1 and the same applies to the outlet 5 to the other front wall 10.

Figure 8:
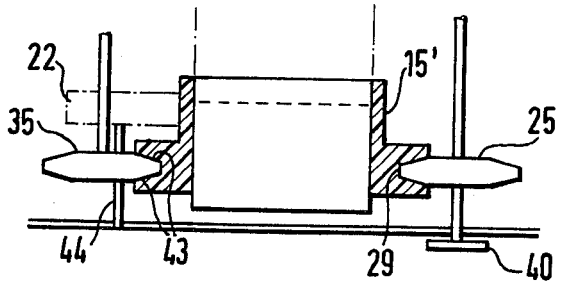
FIG. 8 a cross-sectional view according to line II—II in FIG. 7 (representation of support, drive and transmission with wedge friction wheels)

The calibrating cylinder 11 consists of a screening drum 12 provided with screening holes 13 or with a wire lattice (FIG. 6) on the two ends of which a running ring 14 or a driving ring 15 of plastic material is placed. A tightening disk 16 which is tightened against a paddle shaft 19 with inclined paddles 20 arranged centrally in the interior of the calibrating cylinder 11 with the help of its arms 17 and a tightening nut 18 fixes the running ring 14 vis-a-vis the screening drum 12. A tightening star 21 welded to the paddle shaft 19 connects in the same manner, through power locking, the driving ring 15 with the screening drum 12. The paddle shaft 19 thus constitutes, on the one hand, transportation means by handling the transporting of the screening transitions through the calibrating cylinder 11 with the help of its paddles 20 and, on the other hand, tightening means to hold the running ring 14 as well as the driving ring 15 on the screening drum 12 in connection with the tightening star 21 and the tightening disk 16 whereby the calibrating cylinder 11 is formed as a whole. The latter rests in a rolling manner on four supporting rolls (two axis-equally arranged supporting rolls 22 and 23 and two also axis-equally arranged driving wheels 24 and 25). Each of the two rolls 22 or 23 made of synthetic material rests in a rotary manner on a shaft stub 44 (FIG. 8) fastened to the front wall 9 or 10. The supporting rolls 23 and 24 interacting with the running ring 14 have a cylindrical running surface and also the supporting roll 22 which interacts with an additional cylindrical supporting surface 15' of the driving ring 15. The driving wheel 25 is provided with a wedge profile with lateral guiding surfaces 43 which engage into a keyway 29 of the of the driving ring 15 and thus interact with it through friction (FIG. 8). There is also a power-locking connection between the rubber running surface of the driving wheel 24 and the cylindrical running surface of the running ring 14 of the calibrating cylinder 11 (FIG. 1).

Figure 7:
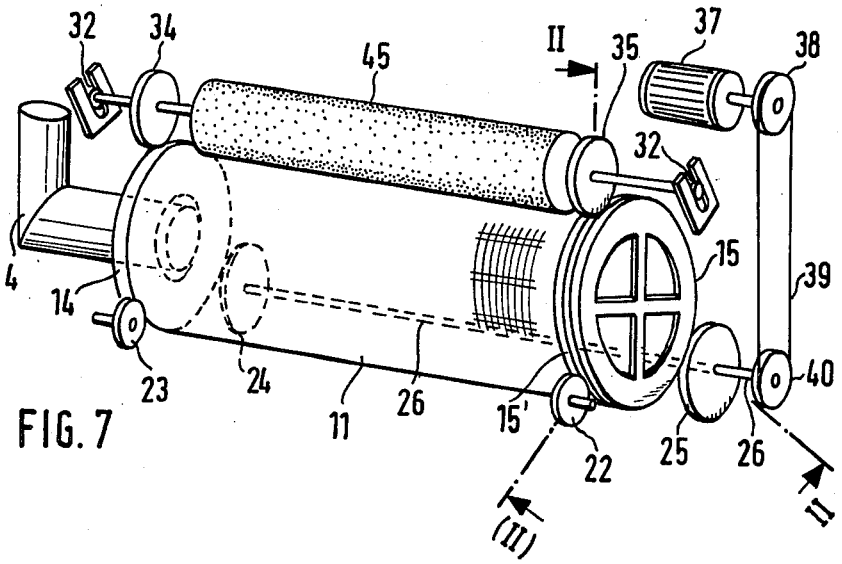
FIG. 7 a representation in principle of the support and drive conditions of the calibrating cylinder and of the cleaning device.
Figure 9:
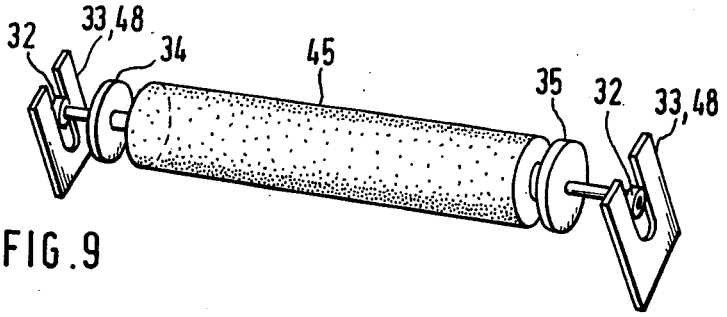
FIG. 9 a perspective representation of the cleaning device and its slide-in reception on its end side in connecting-link-type guides and FIG. 10 a diagram-type representation of principle for the actual calibration process within a seed system.

The cleaning device 45 is designed as a beater shaft 30 with blade-like beaters 31 (FIG. 3) which are made of synthetic material and are fastened in a detachable manner on the shaft 30. The beater shaft 30 rests in two friction bearings 32 (FIGS. 4, 7 and 9) which are each received by a U-shaped slideway 33 in a sliding movement which acts as a sliding connecting link (FIGS. 4 and 9). The connecting link 33 is fastened to the front wall 9 or 10 of the casing by means of screws 36 (FIG. 4). The beater shaft 30 is arranged in a mobile manner cross-axial and relative to the calibrating cylinder 11 with the help of the ball and friction bearings 32 acting at the same time as sliding means in the connecting links 33 radially aligned to the longitudinal axis of the calibrating cylinder 11. A transmission wheel 34 as well as a driving wheel 35 of synthetic material or rubber are arranged in a non-rotary manner on the beater shaft 30 (FIGS. 1, 2, 7 and 9) of which the driving wheel 34 has a cylindrical running surface and is connected in a power-locking fashion with the running ring 14 of the calibrating cylinder 11 (FIGS. 1 and 7). The transmission wheel has a wedge-shaped design with regard to its running surface and engages with it in the keyway 29 on the driving ring 15 of the calibrating cylinder 11 whereby it is connected with it in a power-locking manner (FIGS. 1 and 8).

A geared engine 37 is provided for the drive of the calibrating cylinder 11 and of the beater shaft 30 (FIG. 1) which is arranged on the ceiling of the machine casing 1 and carries a non-rotary chain wheel 38 on its driving shaft. A chain 39 connects it with a chain wheel 40 which is fastened in a non-rotary manner on the shaft 26 of the driving wheels 24 and 25. The torque produced by the geared engine 37 is transmitted to the shaft 26 and thus to the driving wheels 24 and 25 through the two chain wheels 38 and 40 and the chain 39. They drive the calibrating cylinder 11 through friction locking by means of the running ring 14 or driving ring 15 assigned to them. The running ring 14 and the driving ring 15 are additionally in a power-locking connection with the transmission wheel 34 or the driving wheel 35 so that the starting torque is not only transmitted to the calibrated cylinder 11 but, at the same time, on both sides to the beater shaft 30 and thus puts the latter into a rotary motion. The grain flowing into the sorting cylinder through the inlet 4, for example, Indian corn, flows on the front side into the interior of the calibrating cylinder 11. The paddles 12 rotating with the calibrating cylinder 11 immerse into the grain and, owing to their inclined position, push it axially forward on the screening drum 12. The large, thick Indian corn grain is thus transported across the screening drum 12, flows at its end through the tightening star 21 and reaches the outlet 5 as screening transition as well as a discharge line for use as the corresponding quality of the seed. The smaller fraction of the Indian corn grain drops as screening passage through the screening holes 13 or the gap-like openings between the correspondingly designed wire lattice of the screening drum 12 into the discharge funnels 6 and 7 from where they form the corresponding flatter quality of seed through their discharge openings, for example, as flat grain. In the case of Indian corn, it is particularly important owing to the automatic sowing machines that there are no oversized grains in the seed since otherwise the holes or distribution devices of the sowing machine would be blocked. During the sorting process, the beater shaft 30 rotates continuously and its elastic beaters 31 hit the rotating screening drum 12 of the calibrating cylinder 11 whereby Indian corn grains or Indian corn parts stuck in the calibrating openings 13 are pushed back by the beaters or are made to fall through. In this way, the screening drum 12 is continuously cleaned and its calibrating openings 13 are kept free. Since the beaters 31 are preferably made of rubber or leather, the beating is more that of a strong repeated cleaning impact. In this way, it is, under any circumstances, avoided that the high-precision lattice texture or punched sheet is damaged or deformed. The slight wear, which is unavoidable with the continuous use of the sorting cylinder, on the running surfaces of the running ring 14 or of the driving ring 15, on the one hand, and of the supporting rolls 22, 23, 24 and 25 as well as the transmission or driving rolls 34 and 35, on the other hand, has no disadvantageous influence on the drive of the calibrating cylinder 11 and of the beater shaft 30 because the calibrating cylinder 11 is always pushed, due to gravity, on the driving wheels 24 and 25 as well as the carrying rolls 22 and 23 with its running ring 14 or driving ring 15: thus the required power or friction locking is always guaranteed. The same applies to the beater shaft 30 which is mobile relative to the calibrating cylinder 11 in its connecting links 33 so that it can give in in case of wear between the running ring 14 or driving ring 15 and transmission wheel 34 or driving wheel 35 under the influence of the force of gravity whereby the necessary power locking is also maintained in this instance. After a longer period of operation, the rubber or synthetic parts can easily be replaced as parts subject to wear.

Figure 5:
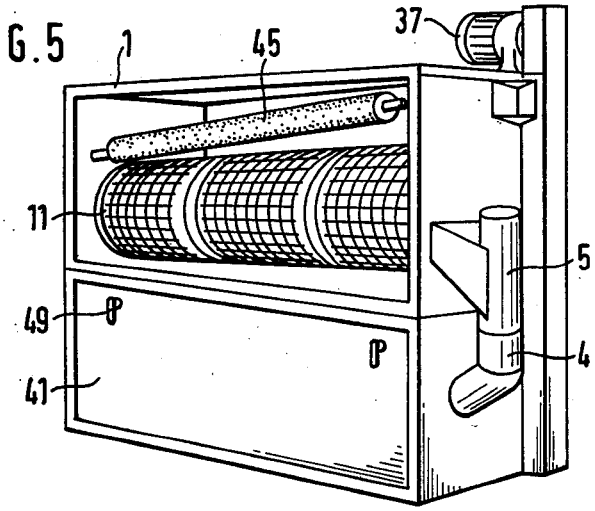
FIG. 5 the position of the cleaning device for the dismounting with the longitudinal side of the machine casing being open.
Figure 6:
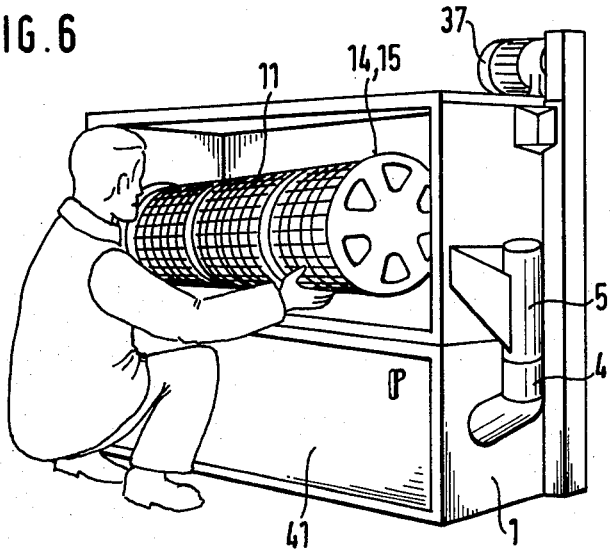
FIG. 6 the structure of the calibrating cylinder through simple lifting off and taking out.

When the calibrating cylinder 11 or the beater shaft 30 must be dismounted, for example, for a change in product, and the screening drum 12 is to be replaced by another one with another type of screening holes, a longitudinal side wall of the machine casing 1 is simply detached by loosening said snap closures 49 (FIGS. 5 and 6). Thus, the beater shaft 30 and the calibrating cylinder 11 are easily accessible. Now, the cleaning device 45 can be easily taken out of the U-shaped connecting links 33 of the guide means 48 and, by means of cross-axial movments, out of the machine casing 1 (FIG. 5). After the beater shaft 30 has been dismounted, the calibrating cylinder 11 can also be quite simply dismounted. This is done by slightly lifting the calibrating cylinder 11 off its supporting rolls 22 and 25 and by subsequent axial and cross-axial movements of same (FIG. 6).

As shown in FIG. 5, the calibrating cylinder 11 can be easily mounted and dismounted without tools by lifting it off its resting point by about the height of the keyway 29 of the driving ring 15, then by pulling it laterally away from the inlet 4 by a length A (see FIG. 2) and subsequently, by removing it from the machine casing 1 by means of a cross-axial movement. The assembly of the mobile basic elements is schematically shown in FIGS. 7 and 8 in relation to the drive and transmission whereby the machine casing 1 has been left out for greater clarity. As to the reference symbols, reference is made to the preceding description.

FIG. 9 shows the cleaning device 45 also in a schematic representation whereby particularly the mobility within the connecting link guides 33 is visible.

Figure 3:
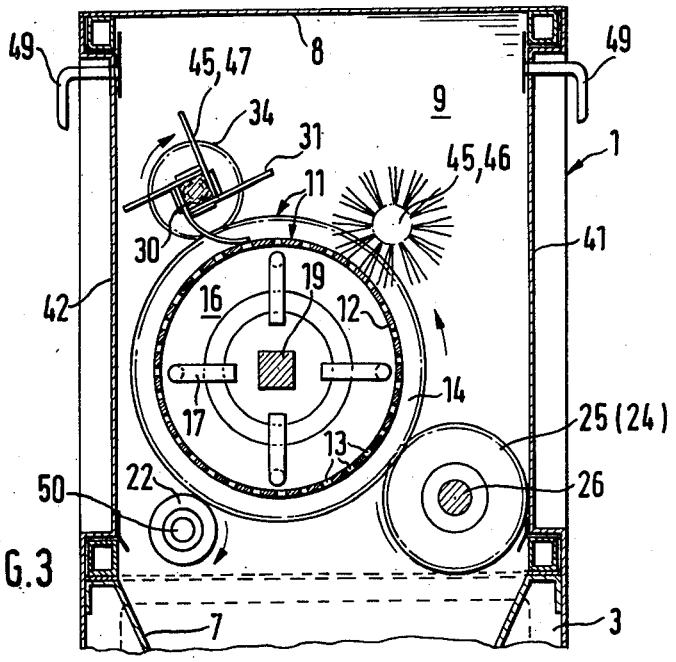
FIG. 3 an enlarged cross-sectional view through the sorting cylinder according to line III—III in FIG. 2 whereby the lower half is shown broken off.
Figure 4:
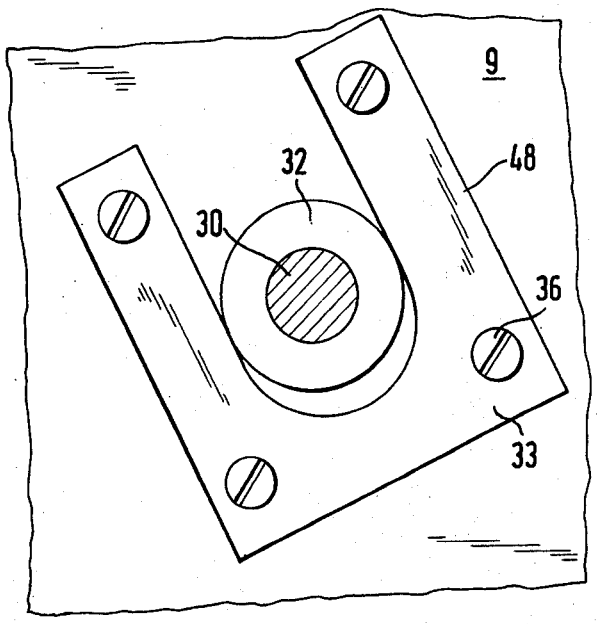
FIG. 4 a cross-sectional view through the cleaning device for the screening drum according to line IV—IV in FIG. 1 on an enlarged scale.

It can be noticed from the representation according to FIG. 3 in what way the two longitudinal side walls 41 and 42 can be easily lifted out of the lower mounting support 50 after having opened the snap closures 49. In practice, it is of great advantage that both sides (i.e. both longitudinal side walls 41 and 42) can be opened so that the removal can be effected depending on the given local situation or the operating possibilities. For this purpose, guide means 48 can be provided left and right, i.e. twice, as this is, for example, shown in FIG. 3. The cleaning device 45, for example, in the form of brushes 46 or a beater system 47, could also be driven directly by the driving motor 37 (not shown in the figures). In case of a rigid installation of a corresponding cleaning device 45, care must be taken that unimpeded mounting and dismounting of the calibrating cylinder 11 is nevertheless possible. In this instance, the supporting roll 22, the driving wheel 25 as well as the cleaning device 45 must have, vis-a-vis the center of the calibrating cylinder 11, an angle of less than 180° or the free space for the dismounting of the calibrating cylinder must be opened more than 180°. The outlets 6 and 7 can be led, as shown in FIG. 1, downward or also far to a longitudinal side so that, when several machines must be placed on top of each other, the lower outlet funnel 6 and 7 is always arranged in the upper right-hand corner (according to a representation of FIG. 3). In this case, the left longitudinal side wall can be opened which involves no disadvantages for the solution as shown in FIG. 3 since the cleaning device 45 as well as the calibrating cylinder 11 can be freely lifted out towards the same side in this case.

Figure 10:
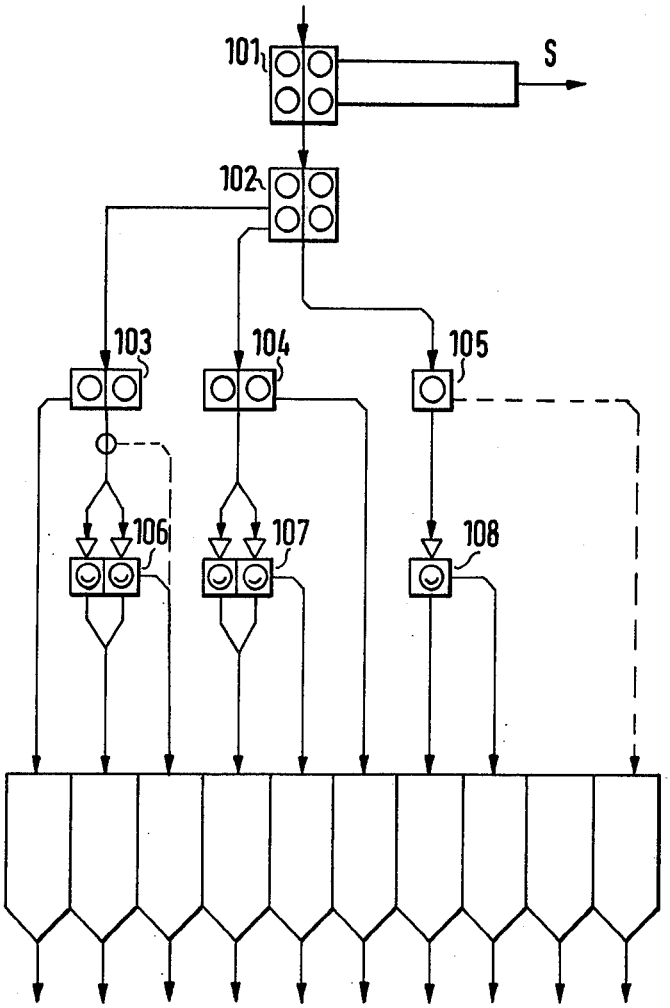

The representation in principle of the actual calibrating process within a seed system shows in the form of a diagram in FIG. 10 that the product enters the four sorting cylinders 101 from the top and pushes the coarser fraction out which are led to further processing as waste S. The four identical sorting cylinders 101 are placed in parallel towards each other for a high output (in the representation according to FIG. 10). The product falling through these sorting cylinders 101 is then led to another sorting cylinder group 102 for calibration where each sorting cylinder produces two coarse and a fine fraction for another subsequent calibration. The two coarse fractions as well as the fine fraction are supplied to the additional cylinders 103 or 104 or 105 for further calibration. The fine fractions of the sorting cylinders 103, 104 and 105 are led to separators 106, 107 and 108 for sorting by length. The final products are stored in the respective storage cells (without reference symbol in FIG. 10) from where they are removed when required.

The calibration with the sorting cylinders represents the most important function for the correct separation by size of grain products and takes place in systems specially built for this purpose.

Obviously, numerous modifications and variations of the present invention are possible in light of the above teachings. It is therefore to be understood that within the scope of the appended claims, the invention may be practiced otherwise than as specifically described herein.

We claim:

1. A sorting cylinder for seeds and other grains, comprising:

a horizontal calibrating cylinder;

first, second, third and fourth supporting rolls for supporting said calibrating cylinder, said first and second rolls being arranged on opposite ends of said calibrating cylinder;

a stationary machine casing surrounding said calibrating cylinder, said casing having a longitudinal side, an inlet for receiving material to be sorted and means for leading off fractions thereof and a detachable longitudinal side wall wherein said calibrating cylinder further comprises a running ring and a driving ring, said driving ring having a circumferential keyway at an end on a driving side thereof and wherein said fourth supporting roll further comprises a driving wheel frictionally engaged with said keyway, said driving wheel having a correspondingly wedge-shaped profile for enabling the calibrating cylinder to be freely lifted off upwardly and to be mounted and dismounted through said longitudinal side of said machine casing wherein said driving ring has a laterally disposed circular-cylindrical running surface and said first supporting roll is arranged on the driving side and has a circular-cylindrical supporting surface such that the running surface rests on said first supporting roll;

a cleaning device for cleaning said calibrating cylinder wherein said calibrating cylinder and said cleaning device utilize said driving ring as a joint driving element and wherein said cleaning device further comprises a transmission wheel having a corresponding wedge profile for cooperative engagement with said running wheel;

U-shaped guide means fastened to said machine casing and within which said cleaning device is guided in a displaceable manner relative to said calibrating cylinder; and sliding means located on first and second ends of said cleaning device and which is inserted into said guiding means.

2. A sorting cylinder according to claim 1, wherein said calibrating cylinder further comprises a running ring disposed on an end thereof opposite said driving ring.

3. A sorting cylinder according to claim 1, further comprising a continuous driving shaft wherein said driving wheel is rigidly connected with said third supporting roll on an opposite end of said calibrating cylinder via said continuous driving shaft.

4. A sorting cylinder according to claim 1, wherein said inlet projects into said calibrating cylinder and said calibrating cylinder ends in front of a corresponding end wall of said machine casing by a larger distance than a depth of projection of said inlet into said calibrating cylinder for assisting the mounting and dismounting of said calibrating cylinder.

5. A sorting cylinder according to claim 1, wherein said third and fourth supporting rolls each further comprise driving wheels made of rubber and wherein the driving ring and the running ring further comprise a wear-resistant synthetic material.

6. A sorting cylinder according to claim 1, wherein said cleaning device further comprises a rotating brush.

7. A sorting cylinder according to claim 1, further comprising means for moving said cleaning device in said guide means essentially radially to said calibrating cylinder such that the direction of movement is vertical or slightly inclined to vertical.

8. A sorting cylinder according to claim 1, wherein said calibrating cylinder further comprises a paddle shaft and a screening drum wherein said screening drum, said running ring, said driving ring and said paddle shaft are fitted into each other so as to form a component.

9. A sorting cylinder according to claim 1, wherein said calibrating cylinder further comprises a plurality of different calibrating cylinders.

10. A sorting cylinder according to claim 1, wherein said cleaning device further comprises a beater system.

11. A sorting cylinder according to claim 1, wherein said calibrating cylinder further comprises a plurality of differently punched screening drums.

* * * * *